US007051662B2

(12) United States Patent
Shenghao et al.

(10) Patent No.: US 7,051,662 B2
(45) Date of Patent: May 30, 2006

(54) TABLE WITH CENTER SUPPORT ASSEMBLY

(75) Inventors: Jin Shenghao, Xiamen (CN); Arvin Patel, Sunnyvale, CA (US)

(73) Assignee: Lifetime Products, Inc., Clearfield, UT (US)

( * ) Notice: Subject to any disclaimer, the term of this patent is extended or adjusted under 35 U.S.C. 154(b) by 150 days.

(21) Appl. No.: 10/681,975

(22) Filed: Oct. 9, 2003

(65) Prior Publication Data

US 2004/0244656 A1 Dec. 9, 2004

(30) Foreign Application Priority Data

Oct. 11, 2002 (CN) ..... 02 2 70119

(51) Int. Cl.
*A47B 3/00* (2006.01)

(52) U.S. Cl. ..... 108/132; 108/129

(58) Field of Classification Search ..... 108/132, 108/129, 130, 131, 133; 240/188.1
See application file for complete search history.

(56) References Cited

U.S. PATENT DOCUMENTS

| | | | |
|---|---|---|---|
| 236,197 | A | 1/1881 | Valley |
| 236,741 | A | 1/1881 | Weaver |
| 769,354 | A | 9/1904 | Mielsen |
| 1,063,642 | A | 6/1913 | Birdsall |
| 1,266,929 | A | 5/1918 | Enis |
| 1,272,187 | A | 7/1918 | Basford |
| 1,296,336 | A | 3/1919 | Stine |
| 1,351,013 | A | 8/1920 | Stine |
| 1,514,418 | A | 11/1924 | Battenfield |
| 1,594,572 | A | 8/1926 | Soltesz |
| 1,659,840 | A | 2/1928 | Smith |
| 1,757,260 | A | 5/1930 | Silverman |
| 1,765,766 | A | 6/1930 | Lyon |
| 1,823,484 | A | 9/1931 | Blumenthal |
| 1,836,843 | A | 12/1931 | Temple |
| 1,836,934 | A | 12/1931 | Morecroft |
| 1,888,117 | A | 11/1932 | Fox |
| 1,956,946 | A | 5/1934 | Duffy |
| 2,109,869 | A | 3/1938 | Ross |
| 2,257,550 | A | 9/1941 | Gay |
| 2,278,810 | A | 4/1942 | Virtue |
| 2,326,461 | A | 8/1943 | Howe |

(Continued)

FOREIGN PATENT DOCUMENTS

| | | |
|---|---|---|
| AU | 223700 | 5/1958 |

(Continued)

*Primary Examiner*—Jose V. Chen
(74) *Attorney, Agent, or Firm*—Workman Nydegger

(57) ABSTRACT

A table includes a table top and a table frame. The table frame preferably includes one or more side rails, end rails, table legs, and support braces. The table also includes a mounting structure that is provided on the underside of the table top. At least a portion of a support assembly is connected to the mounting structure. Desirably, the mounting structure and the support assembly are disposed towards the center portion of the table, but the mounting structure and/or support assembly could be located in any desired portion of the table. Preferably, one end of the support braces is pivotally attached to the support assembly and the other end is pivotally attached to a table leg. Advantageously, the support assembly provides a "planar" support area to a portion of the table top. In addition, the mounting structure forms a unitary storage space around the mounting structure on the bottom surface of the table top so that structures of table legs from opposing sides can share the storage space in embodiments of tables having shorter table tops.

20 Claims, 4 Drawing Sheets

U.S. PATENT DOCUMENTS

| | | | |
|---|---|---|---|
| 2,411,658 | A | 11/1946 | La Rue |
| 2,452,169 | A | 10/1948 | Wells |
| 2,470,869 | A | 5/1949 | Schmidt |
| 2,512,473 | A | 6/1950 | Alch |
| 2,522,642 | A | 9/1950 | Schmidt |
| 2,524,198 | A | 10/1950 | La Rue |
| 2,548,682 | A | 4/1951 | Price |
| 2,558,465 | A | 6/1951 | Seymour |
| 2,568,622 | A | 9/1951 | Hagan |
| 2,579,924 | A | 12/1951 | Krasney |
| 2,583,247 | A | 1/1952 | Aja et al. |
| 2,621,710 | A | 12/1952 | Miller |
| 2,647,562 | A | 8/1953 | Hoffar |
| 2,661,792 | A | 12/1953 | Lysaght |
| 2,670,031 | A | 2/1954 | Melges |
| 2,689,158 | A | 9/1954 | Mahr |
| 2,690,210 | A | 9/1954 | Holick |
| 2,717,028 | A | 9/1955 | Villemune |
| 2,717,631 | A | 9/1955 | Howe |
| 2,722,971 | A | 11/1955 | Gallagher et al. |
| 2,748,837 | A | 6/1956 | Beller |
| 2,752,987 | A | 7/1956 | Smithers |
| 2,756,082 | A | 7/1956 | Pucci |
| 2,766,812 | A | 10/1956 | Schrader |
| 2,771,937 | A | 11/1956 | Wilson |
| 2,780,506 | A | 2/1957 | Howe |
| 2,788,059 | A | 4/1957 | Mackintosh |
| 2,800,379 | A | 7/1957 | Smithers |
| 2,805,708 | A | 8/1957 | Bohn |
| 2,811,197 | A | 10/1957 | Nimmo |
| 2,811,400 | A | 10/1957 | James |
| 2,825,390 | A | 3/1958 | Post |
| 2,831,688 | A | 4/1958 | Knox |
| 2,837,141 | A | 6/1958 | Shore |
| 2,849,053 | A | 8/1958 | Beller et al. |
| 2,878,589 | A | 3/1959 | Howe et al. |
| 2,936,820 | A | 5/1960 | Blink et al. |
| 2,939,516 | A | 6/1960 | Drew |
| 2,959,209 | A | 11/1960 | Lakin |
| 2,964,368 | A | 12/1960 | Heyer |
| 2,978,754 | A | 4/1961 | Wilson |
| 2,983,308 | A | 5/1961 | Horowitz |
| 2,992,043 | A | 7/1961 | Nelson |
| 2,999,729 | A | 9/1961 | Semmelroth |
| 3,025,120 | A | 3/1962 | Howe |
| 3,027,209 | A | 3/1962 | Nielsen |
| 3,030,728 | A | 4/1962 | Wesman |
| 3,041,775 | A | 7/1962 | Brown, Jr. et al. |
| 3,079,197 | A | 2/1963 | Mugler |
| 3,080,193 | A | 3/1963 | Nimmo |
| 3,093,924 | A | 6/1963 | Pompa |
| 3,096,866 | A | 7/1963 | Glass |
| 3,101,062 | A | 8/1963 | Kanzelberger |
| 3,112,954 | A | 12/1963 | Kanitz |
| 3,141,424 | A | 7/1964 | Seymour |
| 3,143,982 | A | 8/1964 | Blink et al. |
| 3,144,236 | A | 8/1964 | Clanin |
| 3,166,029 | A | 1/1965 | Acton |
| 3,174,796 | A | 3/1965 | Brown |
| 3,191,991 | A | 6/1965 | Anderson et al. |
| 3,256,037 | A | 6/1966 | Giambalvo |
| 3,259,426 | A | 7/1966 | Shaw et al. |
| 3,267,886 | A | 8/1966 | Glass |
| 3,273,936 | A | 9/1966 | Deavers |
| 3,276,815 | A | 10/1966 | Cardy |
| 3,337,262 | A | 8/1967 | Katzfey et al. |
| 3,349,728 | A | 10/1967 | Barecki et al. |
| 3,353,867 | A | 11/1967 | Anderson |
| 3,357,729 | A | 12/1967 | Krueger |
| 3,410,232 | A | 11/1968 | Krueger |
| 3,429,283 | A | 2/1969 | Uhor |
| 3,439,634 | A | 4/1969 | Bender |
| 3,545,738 | A | 12/1970 | Stagg |
| 3,574,393 | A | 4/1971 | Hughes |
| 3,580,632 | A | 5/1971 | Seymour |
| 3,650,560 | A | 3/1972 | Wohlk |
| 3,672,719 | A | 6/1972 | Haukedahl |
| 3,692,358 | A | 9/1972 | Sung |
| 3,731,971 | A | 5/1973 | Siogren |
| 3,762,626 | A | 10/1973 | Dorsey |
| 3,765,719 | A | 10/1973 | Silver |
| 3,769,920 | A | 11/1973 | Weiss |
| 3,788,696 | A | 1/1974 | Loewen |
| 3,797,884 | A | 3/1974 | Gutierrez |
| 3,857,343 | A | 12/1974 | Greenberg |
| 3,885,829 | A | 5/1975 | Haeger |
| 3,893,400 | A | 7/1975 | Grant |
| 3,905,478 | A | 9/1975 | Peterson et al. |
| 3,922,408 | A | 11/1975 | Smith |
| 3,960,354 | A | 6/1976 | Simikoski |
| 3,994,527 | A | 11/1976 | Nikitits et al. |
| 4,040,658 | A | 8/1977 | Mayol |
| 4,043,277 | A | 8/1977 | Wallace |
| 4,047,754 | A | 9/1977 | Cathey |
| 4,052,100 | A | 10/1977 | Nikitits et al. |
| 4,060,275 | A | 11/1977 | Hansen |
| 4,064,812 | A | 12/1977 | Commanda |
| 4,064,815 | A | 12/1977 | Baum |
| 4,070,057 | A | 1/1978 | Jones |
| 4,072,231 | A | 2/1978 | Helms |
| 4,111,482 | A | 9/1978 | Jones |
| 4,131,311 | A | 12/1978 | Nikitits et al. |
| 4,157,089 | A | 6/1979 | Loughrey |
| 4,191,111 | A | 3/1980 | Emmert |
| RE30,274 | E | 5/1980 | Bolon et al. |
| 4,249,773 | A | 2/1981 | Giambalvo |
| 4,289,350 | A | 9/1981 | Thomas et al. |
| 4,330,151 | A | 5/1982 | Healey |
| 4,382,627 | A | 5/1983 | Dean |
| 4,415,199 | A | 11/1983 | Wright |
| 4,438,603 | A | 3/1984 | Durkan, Jr. |
| 4,462,636 | A | 7/1984 | Markson |
| 4,471,969 | A | 9/1984 | Zabala et al. |
| 4,489,661 | A | 12/1984 | Fitzgerald |
| 4,537,443 | A | 8/1985 | Bray |
| 4,538,526 | A | 9/1985 | Seeley |
| 4,557,200 | A | 12/1985 | Geschwender |
| 4,572,574 | A | 2/1986 | Fishhaber et al. |
| 4,596,196 | A | 6/1986 | Gunter et al. |
| 4,606,575 | A | 8/1986 | Kodet |
| 4,648,652 | A | 3/1987 | Van Kuren |
| 4,653,804 | A | 3/1987 | Yoo et al. |
| 4,700,987 | A | 10/1987 | Sraka et al. |
| 4,740,032 | A | 4/1988 | Olsen et al. |
| 4,744,309 | A | 5/1988 | Kiesel et al. |
| 4,762,321 | A | 8/1988 | Chang |
| 4,815,394 | A | 3/1989 | Ettlinger et al. |
| 4,817,902 | A | 4/1989 | Mason |
| 4,822,066 | A | 4/1989 | Rehrig |
| 4,826,244 | A | 5/1989 | Choi |
| 4,834,450 | A | 5/1989 | Stickler |
| 4,841,877 | A | 6/1989 | Virtue |
| 4,841,879 | A | 6/1989 | Ferguson |
| 4,864,941 | A | 9/1989 | Goulter |
| 4,883,314 | A | 11/1989 | Sakong |
| 4,903,686 | A | 2/1990 | Jennings |
| 4,951,576 | A | 8/1990 | Cobos et al. |
| 4,960,303 | A | 10/1990 | York |
| 4,998,395 | A | 3/1991 | Bezner |
| 5,007,673 | A | 4/1991 | Cheng |
| 5,009,170 | A | 4/1991 | Spehar |
| 5,014,628 | A | 5/1991 | Roberts |
| 5,018,785 | A | 5/1991 | Monson et al. |
| 5,029,938 | A | 7/1991 | Song |

| | | | |
|---|---|---|---|
| 5,060,902 | A | 10/1991 | Hartman |
| 5,070,664 | A | 12/1991 | Groh et al. |
| 5,109,778 | A | 5/1992 | Berkowitz et al. |
| 5,149,575 | A | 9/1992 | Soifer |
| 5,208,084 | A | 5/1993 | Rutz |
| 5,240,307 | A | 8/1993 | Jones et al. |
| 5,271,338 | A | 12/1993 | Bonham |
| 5,279,233 | A | 1/1994 | Cox |
| 5,284,100 | A | 2/1994 | Thorn |
| 5,314,231 | A | 5/1994 | Otterbacher |
| 5,323,713 | A | 6/1994 | Luyk et al. |
| 5,325,793 | A | 7/1994 | Martin |
| 5,335,594 | A | 8/1994 | Karlyn et al. |
| D350,862 | S | 9/1994 | Beller |
| 5,357,872 | A | 10/1994 | Wilmore |
| 5,377,601 | A | 1/1995 | Cashen |
| 5,394,808 | A | 3/1995 | Dutro et al. |
| 5,409,245 | A | 4/1995 | Kern et al. |
| 5,411,314 | A | 5/1995 | Wallace |
| 5,421,272 | A | 6/1995 | Wilmore |
| 5,440,857 | A | 8/1995 | Shanok et al. |
| 5,443,020 | A | 8/1995 | Price |
| 5,483,901 | A | 1/1996 | Tisbo et al. |
| 5,488,926 | A | 2/1996 | Hunt |
| 5,505,142 | A | 4/1996 | Fink |
| 5,536,552 | A | 7/1996 | Scripsick |
| 5,622,120 | A | 4/1997 | Yeh |
| 5,623,882 | A | 4/1997 | Price |
| 5,626,339 | A | 5/1997 | Schickert et al. |
| 5,638,761 | A | 6/1997 | Berkowitz et al. |
| 5,678,491 | A | 10/1997 | Price et al. |
| 5,694,865 | A | 12/1997 | Raab |
| 5,730,066 | A | 3/1998 | Auten et al. |
| 5,732,637 | A | 3/1998 | Raab |
| 5,860,367 | A | 1/1999 | Riegel et al. |
| 5,865,128 | A | 2/1999 | Tarnay |
| 5,868,081 | A | 2/1999 | Raab |
| 5,909,021 | A | 6/1999 | Duffy |
| 5,921,623 | A | 7/1999 | Nye et al. |
| 5,947,037 | A | 9/1999 | Hornberger et al. |
| D414,626 | S | 10/1999 | Collins et al. |
| 5,983,807 | A | 11/1999 | Tarnay et al. |
| 5,984,047 | A | 11/1999 | Rogers |
| 6,000,345 | A | 12/1999 | Gillotti |
| D419,332 | S | 1/2000 | Collins et al. |
| D420,527 | S | 2/2000 | Pinch et al. |
| 6,032,585 | A | 3/2000 | Pinch |
| D423,258 | S | 4/2000 | Pinch |
| 6,058,853 | A | 5/2000 | Pinch |
| 6,076,472 | A | 6/2000 | Lloyd |
| 6,086,148 | A | 7/2000 | Gatto et al. |
| 6,109,687 | A | 8/2000 | Nye et al. |
| 6,112,674 | A | 9/2000 | Stanford |
| D442,788 | S | 5/2001 | Nye et al. |
| 6,334,400 | B1 | 1/2002 | Nien |
| 6,347,831 | B1 | 2/2002 | Nye et al. |
| 6,371,034 | B1 | 4/2002 | Simpson et al. |
| 6,431,092 | B1 | 8/2002 | Stanford |
| 6,530,331 | B1 | 3/2003 | Stanford |
| 6,550,404 | B1 | 4/2003 | Stanford |
| 6,615,743 | B1 * | 9/2003 | Nien ..... 108/132 |
| 6,622,644 | B1 | 9/2003 | Buono |
| 6,651,568 | B1 | 11/2003 | Buono |
| 6,823,806 | B1 | 11/2004 | Buono |
| 2003/0127028 | A1 | 7/2003 | Baik et al. |
| 2003/0177962 | A1 | 9/2003 | Stanford |
| 2003/0233967 | A1 | 12/2003 | Lin |
| 2004/0099189 | A1 | 5/2004 | Stanford |
| 2004/0187747 | A1 | 9/2004 | Shenghao et al. |
| 2004/0187748 | A1 | 9/2004 | Shenghao et al. |
| 2004/0194675 | A1 | 10/2004 | Shenghao et al. |
| 2004/0237856 | A1 | 12/2004 | Shenghao et al. |
| 2004/0244656 | A1 | 12/2004 | Shenghao et al. |
| 2005/0045075 | A1 | 3/2005 | Stanford |
| 2005/0045076 | A1 | 3/2005 | Stanford |

FOREIGN PATENT DOCUMENTS

| | | |
|---|---|---|
| BE | 650758 | 11/1964 |
| CA | 2166651 | 7/1996 |
| DE | 341007 | 5/1920 |
| DE | 3705566 | 9/1988 |
| EP | 0572331 | 12/1933 |
| FR | 2553644 | 4/1985 |
| FR | 2637474 | 4/1990 |

* cited by examiner

TABLE WITH CENTER SUPPORT ASSEMBLY

CROSS-REFERENCE TO RELATED APPLICATIONS

This application claims priority to and benefit of Chinese Application No. 02270119.2 filed Oct. 11, 2002 and entitled "A Type of Plastic Folding Table," which application is incorporated herein by reference in its entirety.

BACKGROUND OF THE INVENTION

1. Field of the Invention

The present invention generally relates to furniture such as tables and, in particular, to tables with a center support assembly.

2. Description of Related Art

A wide variety of tables are well known in the art and used for a variety of purposes. For example, a well-known type of table is commonly referred to as a utility table. Conventional utility tables often include two leg assemblies that are pivotally connected to the table top. The leg assemblies are typically movable between a collapsed position in which the legs are located near the lower surface of the table top and an extended position in which the legs extend outwardly from the table top.

A conventional folding table that can be used, for example, for outdoor activities is shown in FIG. 1. Its main components include a table top 1' and table frame 2'. As shown in the accompanying figure, the table frame 2' includes two side rails 21', three cross bars 22', two sets of foldable legs 23', and two support braces 24'. The side rails 21' are typically fastened to the underside of the table top 1'. The three cross bars 22' are separately and pivotally attached to both ends and the middle portion of the side rails 21'. The two sets of table legs 23' are connected to the cross bars 22' that are located near the ends of the side rails 22'. In addition, one end of each support brace 24' is fastened to the table leg 23' and the other end of the support brace is pivotally attached to the cross bar 22' that is attached to the center portion of the side rails 21'.

When folding the table legs 23' of the conventional table shown in FIG. 1 into the collapsed position, one typically turns the table top 1' so that the underside of the table top is facing upwards. The table legs 23' are then folded downwardly towards the table top. Because the cross bars 22' that are fastened to the table legs 23' are pivotally attached to the side rails 21', and the support braces 24' are pivotally attached to the table legs 23', the table legs 23' come to rest on the underside of the table top 1', thus reducing its volume.

The center portion of the table top 1' of this type of conventional folding table, however, is only supported by one cross bar 22' that pivotally attached to the two support braces 24'. This may allow the center portion of the table to undesirably deflect, shift or move. In addition, if the cross bar 22' in the center portion of the table top is damaged, the entire table frame 2' must be removed in order to repair or replace the damaged cross bar. Removing the entire table frame 2' from the table top 1' typically requires a significant amount of time and effort.

Additionally, the central cross bar 22' divides the underside of the table top 1' into two distinct storage spaces and the two sets of table legs 23' are both separately stored within these spaces when the legs are folded into the collapsed position. This requires that the length of the table top 1' be at least slightly longer than the sum of the heights of the two table legs 23'. Disadvantageously, this may undesirably restrict the size and design of the table. For example, if a folding table having a relatively small table top 1' is desired, then the table legs 23' must be extendable or otherwise adjustable so that the table has the proper height. The extendable or adjustable legs, however, are often undesirably costly and complicated.

SUMMARY OF THE INVENTION

A need therefore exists for a table that eliminates the above-described disadvantages and problems.

One aspect of the invention is a table with legs that are movable relative to the table top between a collapsed position in which the legs are positioned proximate the lower surface of the table top and an extended position in which the legs extend outwardly from the table top. The table legs are preferably securely connected to the table top and the table legs may securely support the table top above a surface such as the floor. Advantageously, the table may allow for different sizes of table tops without being restricted by the length of the table legs and without requiring expensive and complicated modifications to the table legs.

Another aspect is a folding table that includes a table top with a top surface and a bottom surface; a mounting structure centrally disposed on the bottom surface of the table top, the mounting structure forming a unitary storage space on the bottom surface of the table top; a support assembly at least partially connected to the mounting structure; and a frame assembly including a first leg connected to the bottom surface of the table top; and a support brace having a first end and a second end, the first end being attached to the first leg and the second end being attached to the support assembly.

The mounting structure may include a pair of C-shaped mounting ridges formed on the bottom surface of the table top.

The support assembly may include a pair of spaced apart side rails configured to be attached to the mounting structure; and a first cross bar disposed transverse to the pair of side rails.

The support assembly may include a pair of spaced apart side rails configured to be attached to the mounting structure; and a pair of spaced apart end rails disposed transverse to the pair of side rails.

The support assembly may be formed integrally with the table top.

The table top may be formed of blow-molded plastic.

The mounting structure may be formed of blow-molded plastic.

The frame assembly may include a pair of spaced apart side rails and a pair of spaced apart end rails disposed transversely to the pair of side rails and connected therebetween, wherein the table leg is connected to one of the pair of end rails.

The frame assembly may include a second leg connected to the bottom surface of the table top; and a second support brace having a first end and a second end, the first end being attached to the second leg and the second end being attached to the support assembly, wherein the unitary storage structure is configured to receive at least a portion of the first leg and at least a portion of the second leg when the first leg and the second leg are in a folded position.

A further aspect is a table in which the center portion of the table is supported by the central support assembly. Preferably, the support braces are pivotally attached to the central support assembly, but the support braces do not have to be pivotally attached to the central support assembly. Advantageously, the central support may provide increased support for the center portion of the table. In addition, the central support assembly and/or the mounting structure provides a "planar" support strength that may be greater than the "linear" support strength of conventional tables.

The unitary storage space on each side of the mounting structure provides a storage space for structures from opposing table legs, making it possible to fold the table legs beside each other within the table. Thus, the length of the table is not restricted by the sum of the length of the table legs. Additionally, it does not require that the table legs be designed with complicated and costly extension mechanisms.

In addition, if the central support assembly is damaged, all that is required is to detach it from the mounting structure to repair it. It is not necessary to detach the parts of the outer support assembly, and thus less time and effort is required for maintenance.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF THE PREFERRED EMBODIMENTS

The present invention is generally directed to structures having reinforced center regions provided by a generally "H"-shaped center support. Advantageously, the "H"-shaped center support may provide a "planar" support structure versus the "linear" support structure that was provided in conventional tables. The "H"-shaped center support may provide added strength to the structure, whether the structure is a table, chair, shelf, or other type of furniture. While the present invention is described with relation to a folding table, it will be appreciated that the "H"-shaped center support may be used in connection with other suitable types structures.

Figure 1:
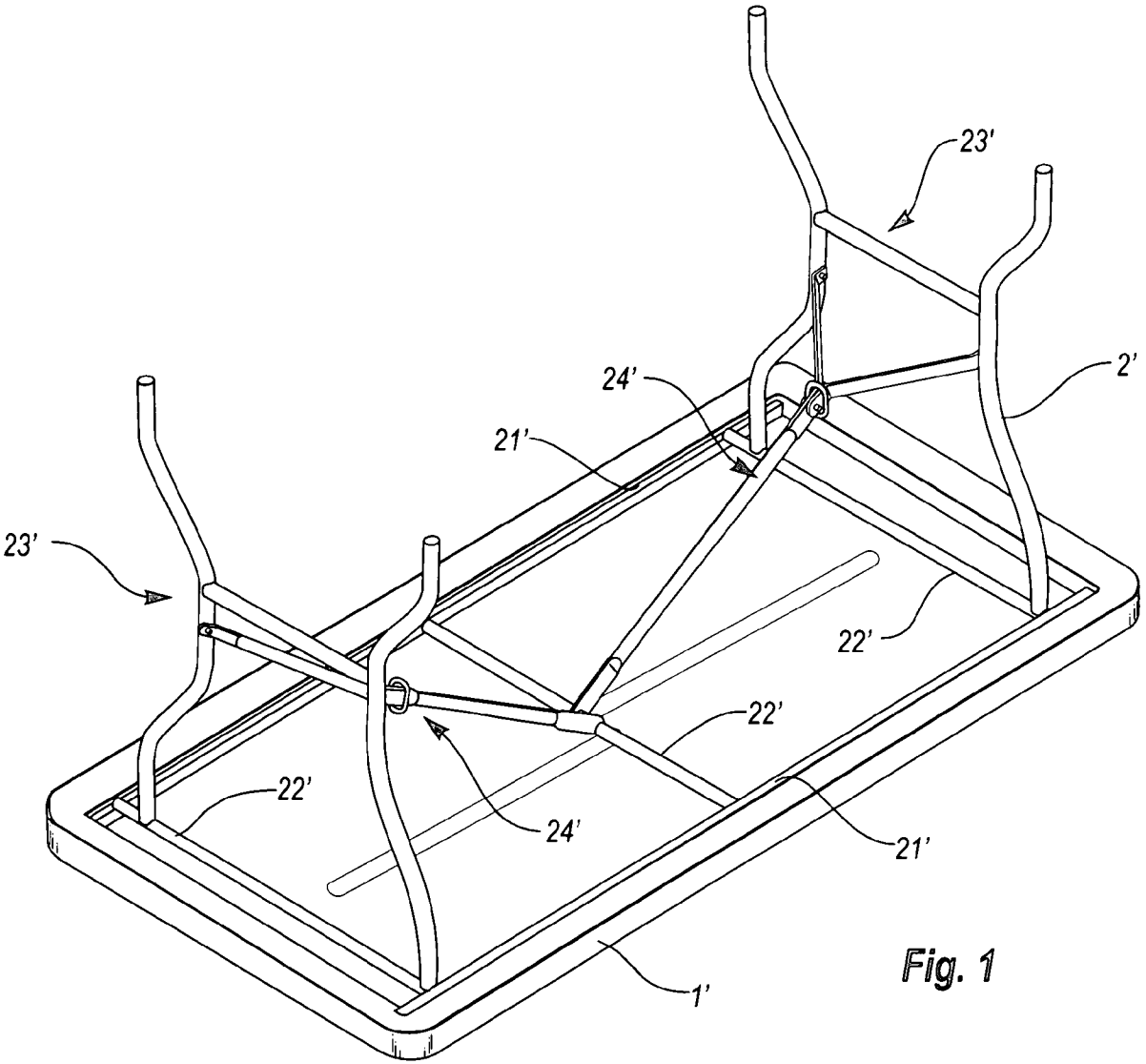
FIG. 1 is a perspective view of a conventional folding table with legs that are pivotally attached to a table frame.
Figure 2:
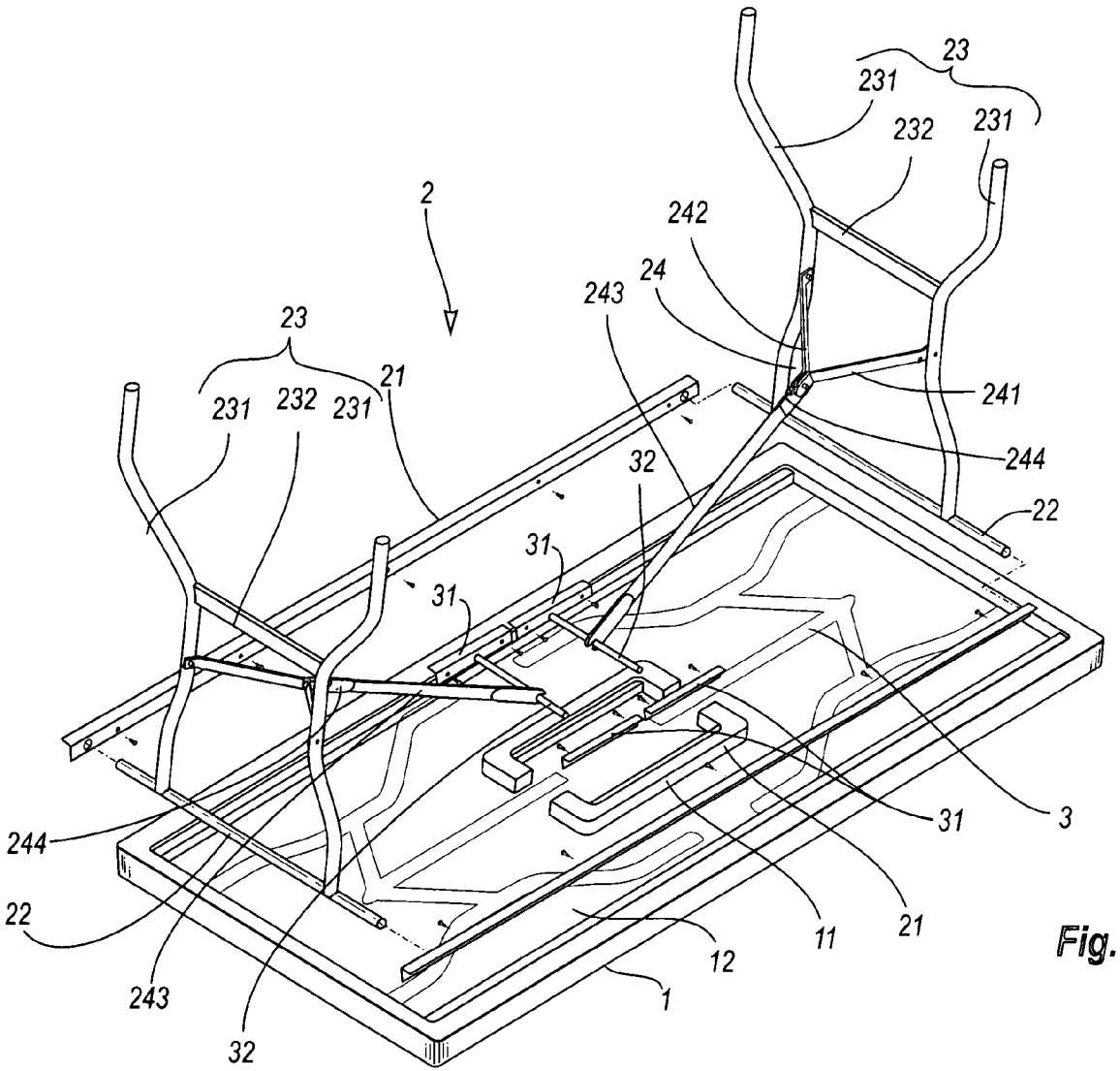
FIG. 2 is an exploded perspective view of a folding table in accordance with a preferred of the present invention.
Figure 3:
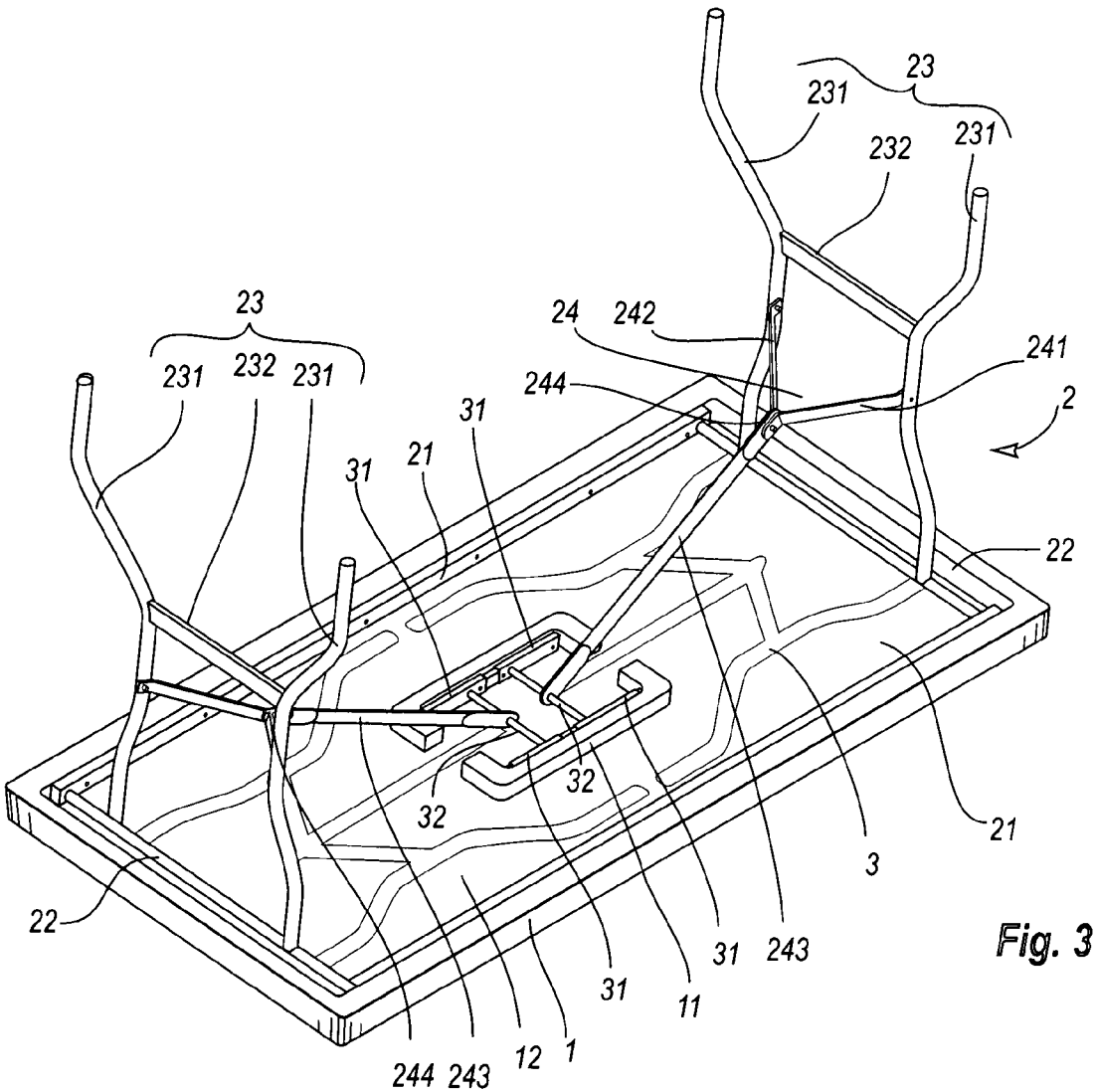
FIG. 3 is a perspective view of the folding table shown in FIG. 2, illustrating the legs in an extended position.

As shown in FIGS. 2 and 3, an exemplary folding table includes a table top 1, a table frame 2, and a support assembly 3. Table top 1 can be constructed out of plastic such as, but not limited to, blow molded plastic or injection molded plastic. Other suitable materials include, but are not limited to wood and metal. The periphery of the bottom surface of the table top 1 forms an integral storage space 12.

Table frame 2 includes two spaced apart side rails 21, two spaced apart cross bars or end rails 22 that are connected to the side rails, two sets of table leg sets 23 connected to the end rails, and two support braces 24. Each side rail 21 is fastened to the underside of one side of table top 1. The side rails 21 include connecting apertures at each end. An end rail 22 is disposed in the facing connecting apertures of a pair of side rails 21.

Each table leg set 23 includes a pair of table legs 231 and a cross bar 232. One end of each table leg set 23 is fastened to an end rail 22. The support braces 24 are constructed from three support bars 241, 242, and 243. One end of the first and second support bars 241 and 242 is separately and pivotally attached to the lower part of the two table legs 231. The other ends converge and are pivotally attached to one end of the third support bar 243. The pivot area on this third support bar 243 is encircled by a sliding locking ring 244 so that, when the table is supported, the force of gravity detains the first and second support bars 241 and 242, preventing the table leg sets 23 from folding and thus increasing the firmness of the table legs 23. The other end of the third support bar 243 is pivotally attached to the support assembly 3.

A mounting structure 11 is formed on the underside of the table top 1. In one embodiment, the mounting structure 11 includes a pair of generally C-shaped mounting ridges each mounting ridge having an elongate central portion and two shorter end portions. The mounting ridges face each other so that a box-like region is formed at the center of table top 1.

The mounting structure 11 can be formed integrally with table top 1 during the blow-molded process or injection molding process to form a one-piece structure. Thus, the mounting structure 11 is formed in a single step and does not require additional manufacturing or cooling time. Alternatively, the mounting structure 11 could be formed from discrete parts and later attached or adhered to table top 1. The mounting structure 11 is configured to support at least a portion or the entire support assembly 3.

The support assembly 3 is preferably constructed with a generally "H"-shape configuration with two side rails 31 and two cross bars or end rails 32. Each side rail 31 is desirably attached to the inside surface of a mounting ridge of the mounting structure 11. The side rails 31 include connecting apertures at each end. An end rail 32 is disposed in the facing connecting apertures of a pair of side rails 31. An end of the third support bar 243 of a support brace 24 is pivotally attached to an end rail 32. One skilled in the art will appreciate that the support assembly 3 could have other suitable shapes and configurations depending, for example, upon the intended use of the table.

Because the support assembly 3 has a generally "H"-shaped structure, the support assembly 3 provides a "planar" support structure to the central portion of table top 1. It will be appreciated that the generally "H"-shaped structure of the support assembly 3 may be formed from two side rails 31 and two end rails 32 or from a single end rail 32 disposed between a pair of end rails 31 (forming a true "H"). A "planar" support structure distributes forces along the plane. In contrast, the center portion of a conventional table top was often supported by a "linear" structure in which the forces were focused along a central line. Thus, failure of the table top 1 is more likely with a "linear" structure than with a "plane" structure. Therefore, the embodiments of the present invention provide unique mounting structures for support braces 24 which ultimately provide greater support strength for the table top 1.

In addition, when support assembly 3 is damaged, it can be replaced or repaired simply by detaching the two side rails 31. Thus, there is no need to go to the trouble of disassembling the entire table frame 2. Furthermore, the ridge-shaped nature of the mounting ridges provides that fastening structure such as bolts, rivets, nails and the like are protected from exposure. Of course, any suitable type of fastener or connectors could be used to attached the support assembly 3 to the table or assemble the table.

Figure 4:
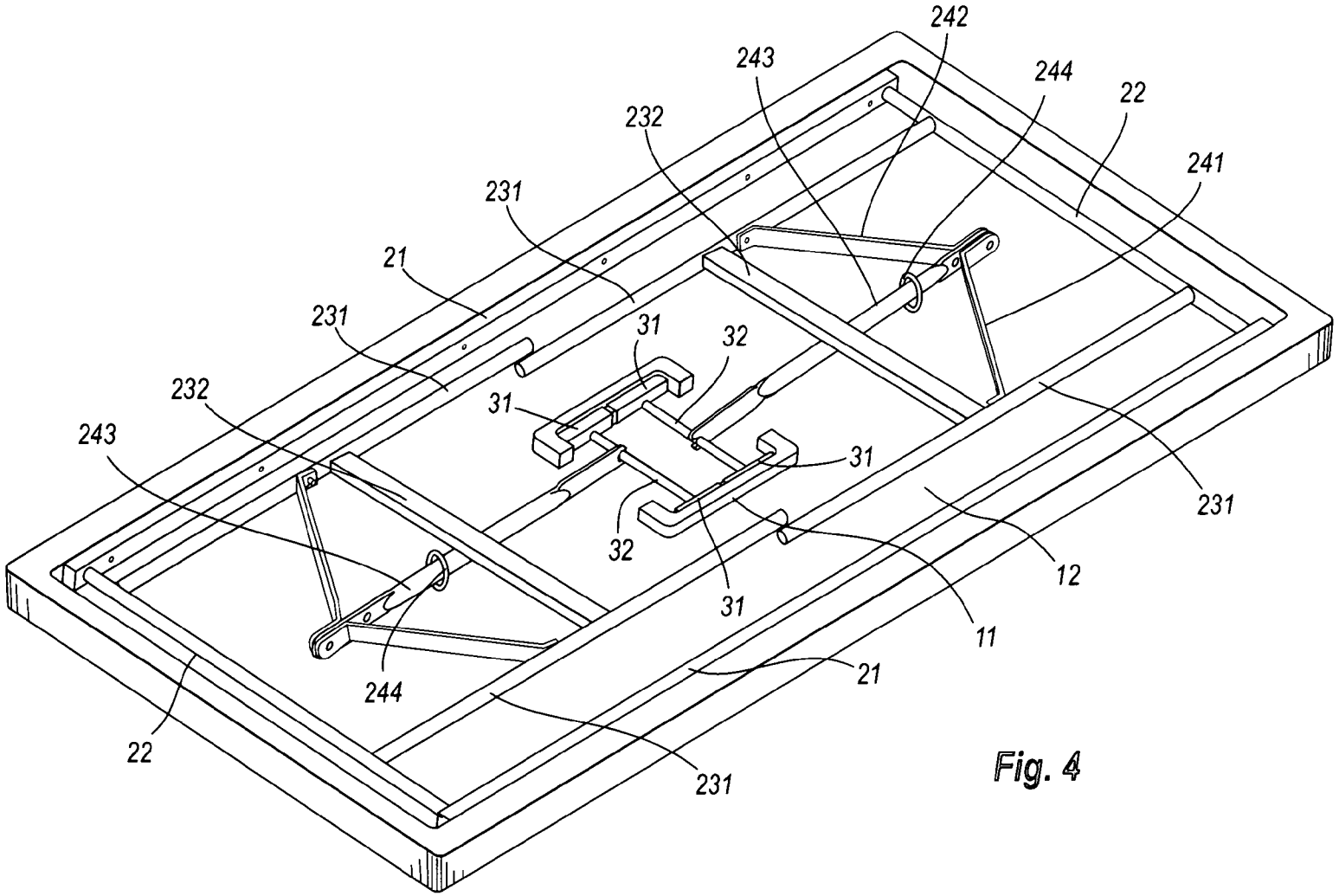
FIG. 4 is a top view of another embodiment of a folding table, illustrating the legs in a collapsed or folded position.

In order to fold the table into the collapsed or storage position, as shown in FIG. 4, the table is preferably turned upside down with the underside facing up. Under the effect of gravity, the locking ring 244 may automatically slide down under the effect of its own weight and will remove the constraint on the pivoting region of the support braces 24. Applying force to the pivoting region folds the two sets of table leg sets 23 in a downwards direction. The table leg sets 23 will come to rest on the underside of the table top 1, thus facilitating storage or transport.

It will be appreciated that the "H"-shaped support assembly may be used in any table or structure requiring such support. For example, the "H"-shaped support structure may be used in non-folding tables. It may also be used for other structure including chairs, shelving, and the like. Further, depending upon the type of structure used in connection with the support assembly, the support assembly could have other suitable shapes, sizes and configurations.

With reference to FIG. 4, an alternative embodiment of a folding table is shown. The storage space 12 formed by the blow molded table combined with the central support assembly 3 accommodates for different table designs. For example, because the support assembly 3, including mounting structures 11, are smaller in width than the width of the table leg sets 23, the storage space 12 is not divided by a central cross bar as in conventional folding tables. As such, structures on mirrored halves of the folding table are able to cross over into the storage space of the opposing half.

For example, in an embodiment where the table top 1 is shorter than the sum of the lengths of the table legs 231, each of the table leg sets 23 is able to at least partially share the storage space of the opposing table leg set when the table leg sets 23 are in the folded position. That is, the table leg sets 23 of opposing table leg sets 23 are offset from each other. Thus, when the table leg sets 23 are folded, the table legs 231 rest beside each other. This is possible because there is not an impeding support assembly structure preventing the table legs sets 23 from crossing over into the storage space of the opposing table leg set 23.

In the embodiment of FIG. 4, the table legs 231 are straight. However, the purposes and intent of the invention can be accomplished with curved table legs 231 so long as table legs 231 are positioned on cross bars 22 such that they offset or are displaced in relation to the mirroring table leg set 231 on the opposing table leg set 23.

As such, the length of table top 1 may be varied between longer and shorter lengths without the length being dictated by the length of table legs 231. In addition, where the table top 1 is shorter, the table still maintains a comfortable and adequate height by being able to maintain legs 231 at a standard or desired height rather than shortening the table legs to accommodate a shorter table top. In addition, by providing a storage space 12, costly modifications to table leg sets 23 are avoided.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A table comprising:

a table top including a top surface and a bottom surface;

a mounting structure generally centrally disposed on the bottom surface of the table top, the mounting structure including a first mounting ridge and a second mounting ridge;

a unitary storage space disposed about at least a portion of the mounting structure;

a support assembly at least partially connected to the mounting structure, the support assembly comprising:

a first side rail attached to the first mounting ridge of the mounting structure;

a second side rail attached to the second mounting ridge of the mounting structure; and at least one cross bar at least partially disposed between and connected to the first side rail and the second side rail; and a frame at least partially connected to the bottom surface of the table top, the frame comprising:

a first side rail attached to a first side of the table top;

a second side rail attached to a second side of the table top;

a first leg assembly connected to the first side rail and the second side rail of the frame;

a second leg assembly connected to the first side rail and the second side rail of the frame;

a first support brace including a first end connected to the first leg assembly and a second end connected to the support assembly; and a second support brace including a first end connected to the scone leg assembly and a second end connected to the support assembly.

2. The table as in claim 1, wherein the first mounting ridge and the second mounting ridge have a generally C-shaped configuration.

3. The table as in claim 1, wherein the first side rail includes an aperture that is sized and configured to receive an end of the cross bar and the second side rail including an aperture that is sized and configured to receive another end of the cross bar.

4. The table as in claim 1, wherein the first side rail includes a first aperture that is sized and configured to receive an end of a first cross bar and the second side rail includes a first aperture that is sized and configured to receive another end of the first cross bar; and wherein the first side rail includes a second aperture that is sized and configured to receive an end of a second cross bar and the second side rail includes a second aperture that is sized and configured to receive another end of the second cross bar.

5. The table as in claim 1, wherein the first mounting ridge and the second mounting ridge are formed integrally with the table top.

6. The table as in claim 1, wherein the table top is formed of blow-molded plastic.

7. The table as in claim 1, wherein the mounting structure is formed of blow-molded plastic.

8. The table as in claim 1, wherein the frame further comprises a pair of spaced apart end rails that are generally disposed transversely to the first side rail and the second side rail.

9. The table as in claim 1, wherein the first mounting ridge of the mounting structure is disposed proximate the second mounting ridge of the mounting structure.

10. A table comprising:

a table top constructed from blow-molded plastic, the table top including a top portion, a bottom portion, and an outer perimeter;

a first leg assembly selectively movable between an extended position and a collapsed position relative to the table top;

a second leg assembly selectively movable between an extended position and a collapsed position relative to the table top;

a mounting structure including a first generally C-shaped mounting portion and a second generally C-shaped mounting portion, the first and second mounting portions extending outwardly from the bottom portion of the table top, the first and second mounting portions being formed in the bottom portion of the table top as part of a unitary, one-piece construction;

a support assembly including a first side rail attached to the first generally C-shaped mounting portion and a second side rail attached to the second generally C-shaped mounting portion, the support assembly including at least one cross bar connected to the first side rail and the second side rail;

a first support brace including a first end connected to the first leg assembly and a second end being connected to the support assembly; and a second support brace including a first end connected to the second leg assembly and a second end connected to the support assembly.

11. The table as in claim 10, wherein the first side rail has a generally L-shaped cross-section and the first side rail includes at least one aperture that is sized and configured to receive a portion of the at least one cross bar of the support assembly; and wherein the a second side rail has a generally L-shaped cross-section and the second side rail includes at least one aperture that is sized and configured to receive a portion of the at least one cross bar of the support assembly.

12. The table as in claim 10, wherein the first side rail includes an opening that is sized and configured to receive an end of a cross bar; and wherein the second side rail includes an opening that is sized and configured to receive another end of the cross bar.

13. The table as in claim 10, further comprising a frame attached to the table top, the frame including a first side rail and a second side rail, the support assembly being positioned between and spaced apart from the first side rail and the second side rail of the frame.

14. The table as in claim 10, further comprising a lip downwardly extending from the bottom portion of the table top, the lip being formed in the table top as part of the unitary, one-piece construction, the support assembly being positioned at least substantial distance away from the lip.

15. A table comprising:

a table top at least partially constructed from plastic, the table top including an upper portion and a lower portion;

a first leg assembly selectively movable between an extended position and a collapsed position relative to the table top;

a second leg assembly selectively movable between an extended position and a collapsed position relative to the table top;

a mounting structure comprising:

a first generally C-shaped mounting portion; and a second generally C-shaped mounting portion, the first mounting portion and the second mounting portion extending outwardly from the lower portion of the table top, the first mounting portion and the second mounting portion being integrally formed in the lower portion of the table top as part of a unitary, one-piece construction; and a support assembly comprising:

a first side rail attached to the first generally C-shaped mounting portion;

a second side rail attached to the second generally C-shaped mounting portion; and at least one cross bar disposed between and connected to the first side rail and the second side rail of the support assembly.

16. The table as in claim 15, further comprising a first support brace including a first end connected to the first leg assembly and a second end being connected to the support assembly; and a second support brace including a first end connected to the second leg assembly and a second end connected to the support assembly.

17. The table as in claim 15, wherein the first side rail has a generally L-shaped cross-section and the first side rail includes at least one aperture that is sized and configured to receive a portion of the at least one cross bar of the support assembly; and wherein the a second side rail has a generally L-shaped cross-section and the second side rail includes at least one aperture that is sized and configured to receive a portion of the at least one cross bar of the support assembly.

18. The table as in claim 15, wherein the first side rail includes an opening that is sized and configured to receive an end of a cross bar; and wherein the second side rail includes an opening that is sized and configured to receive another end of the cross bar.

19. The table as in claim 15, further comprising a frame attached to the table top, the frame including a first side rail and a second side rail, the support assembly being positioned between and spaced apart from the first side rail and the second side rail of the frame.

20. A table comprising:

a table top constructed from blow-molded plastic, the table top including an upper portion, a lower portion and an outer perimeter;

a first leg assembly selectively movable between an extended position and a collapsed position relative to the table top;

a second leg assembly selectively movable between an extended position and a collapsed position relative to the table top;

a mounting structure formed in the lower portion of the table top as part of a unitary, one-piece structure, the mounting structure comprising:

a first mounting portion extending outwardly from the lower portion of the table top; and a second mounting portion extending outwardly from the lower portion of the table top;

a support assembly positioned proximate a generally central portion of the table top and positioned at least substantial distance away from the outer perimeter of the table top, the support assembly comprising:

a first cross bar including a first end and a second end;

a first side rail being connected to the first mounting portion of the mounting structure, the first side rail being first end of the first cross bar; and a second side rail being connected to the second mounting portion of the mounting structure, the second side rail being connected to second end of the first cross bar;

a first support brace including a proximal end connected to the first leg assembly and a distal end being connected to the support assembly; and a second support brace including a proximal end connected to the second leg assembly and a distal end connected to the support assembly.

* * * * *

UNITED STATES PATENT AND TRADEMARK OFFICE

CERTIFICATE OF CORRECTION

PATENT NO. : 7,051,662 B2
APPLICATION NO. : 10/681975
DATED : May 30, 2006
INVENTOR(S) : Shenghao et al.

It is certified that error appears in the above-identified patent and that said Letters Patent is hereby corrected as shown below:

Title Page
Page 3, Item 56, References Cited, Foreign Patent Documents, insert

| | | | |
|---|---|---|---|
| -- | GB | 10007 | 12/1908 |
| | GB | 145727112/1976 | |
| | GB | 15952108/1981 | |
| | JP | H10-75825 | 3/1998 |
| | TW | 320006 | 3/1997 |
| | WO | WO95/10204 | 4/1995 -- |

Column 1
Line 38, change “22’” to --21’--
Line 54, after “that” insert --is--

Column 3
Line 60, before “structures” insert --of--

Column 5
Line 33, change “are” to --is--

Column 6
Line 37, change “scone” to --second--
Line 44, change “including” to --includes--

Signed and Sealed this

Eleventh Day of September, 2007

JON W. DUDAS
*Director of the United States Patent and Trademark Office*